US005480370A

United States Patent [19]

Gelsinger

[11] Patent Number: 5,480,370

[45] Date of Patent: Jan. 2, 1996

[54] SIDE GUIDING MECHANISM FOR OUTSERT FOLDING MACHINE

[75] Inventor: Timothy L. Gelsinger, Long Valley, N.J.

[73] Assignee: The Challenge Printing Co., Wallington, N.J.

[21] Appl. No.: 154,959

[22] Filed: Nov. 19, 1993

[51] Int. Cl.[6] ..... B31B 1/02

[52] U.S. Cl. ..... 493/475; 493/417; 493/479

[58] Field of Search ..... 493/417, 474, 493/475, 478, 479; 271/240, 250, 253

[56] References Cited

U.S. PATENT DOCUMENTS

| | | | |
|---|---|---|---|
| 937,271 | 10/1909 | Anderson | 271/253 |
| 1,128,537 | 2/1915 | Sigafoos | 271/253 |
| 1,464,945 | 8/1923 | Larson | 271/253 |
| 1,955,398 | 11/1929 | Werner | 493/479 |
| 3,149,564 | 6/1961 | Carlson | 271/253 |
| 4,037,769 | 7/1977 | Meyers | 271/240 |
| 4,667,809 | 5/1987 | Raybuck | 271/240 |
| 4,812,195 | 3/1989 | Vijuk . | |
| 4,817,931 | 4/1989 | Vijuk . | |
| 4,824,095 | 4/1989 | Fort | 271/250 |
| 5,198,067 | 3/1993 | Sumi et al. | 271/250 |
| 5,209,467 | 4/1993 | Schmaling | 271/253 |

FOREIGN PATENT DOCUMENTS

| | | | |
|---|---|---|---|
| 0185757 | 8/1988 | Japan | 271/253 |

*Primary Examiner*—Bruce M. Kisliuk
*Assistant Examiner*—Christopher W. Day
*Attorney, Agent, or Firm*—Meltzer, Lippe, Goldstein et al.

[57] ABSTRACT

A side jogging mechanism for aligning a sheet to be folded into an outsert by an outsert folding apparatus comprises a frame including first and second oppositely disposed side frame members between which the outsert folding apparatus is received, an adjustable solenoid assembly mounted on the first side frame member, and a side stop assembly mounted on the second side frame member. The solenoid assembly includes a solenoid, a plunger extending from and actuated by the solenoid, and a pusher mounted at an end of the plunger located between the first and second side frame members. The side stop assembly includes a side stop located between the first and second side frame members. The solenoid assembly further includes an adjusting mechanism, e.g., a threaded shaft and handwheel, for adjusting the position of the pusher between the first and second side frame members, which adjusting mechanism is located outside the frame. Desirably, the side stop assembly also including an adjusting mechanism, e.g., a threaded shaft and handwheel, for adjusting the position of the side stop between the first and second side frame members, which adjusting mechanism is also located outside the frame.

8 Claims, 5 Drawing Sheets

SIDE GUIDING MECHANISM FOR OUTSERT FOLDING MACHINE

BACKGROUND OF THE INVENTION

The invention relates to an improved side-guiding mechanism for a folding machine. In particular, the invention relates to an improved side guiding mechanism for a folding machine which makes outserts.

An outsert is a sheet which is folded a number of times with the outermost fold being glued tight to an inner fold in order to make a tightly folded packet. FIG. 1 illustrates a typical outsert 12 wherein a last wrap-around panel 14 is adhered by a glue or adhesive spot 15 to an adjacent inner fold 16 to complete outsert 12. Outserts are often very long, for instance, 9 to 50 inches in length, and are often used by the pharmaceutical industry to provide information concerning the drug to which the outsert is attached. Such information might include instructions for use or warnings about possible side effects of the drug. Generally, they are attached to the bottle or box in which the drug is packaged.

U.S. Pat. No. 4,812,195 (incorporated herein by reference) describes an apparatus for automatically forming sheets from a web of material. The apparatus described therein includes an outsert attachment which is attached to the rest of the folding apparatus. The outsert attachment folds and glues the sheets in such a manner as to form outserts similar to the one shown in FIG. 1. FIG. 2, which is adapted from U.S. Pat. No. 4,812,195, illustrates this prior art apparatus for forming outserts of a predetermined length from a web 20 by accumulating long lengths, for example, up to 50 inches of the web 20, in an accumulator 28. A photocell 29 detects marks on the web 20 to operate a severing means 31 at a sheet station 26 to form sheets 11 each of which is the same size. A sheet conveyor 35 extends from the sheet station 26 to a folding station 33. At the folding station 33, folding plates 37 and rollers.(not shown) fold the sheets 11 into the form shown on conveyor 38. As can be seen, a sheet 11 at this point has a folded portion 39 and an unfolded wraparound panel 14, with the folded portion 39 leading the wrap-around panel 14 in the direction of travel shown by the arrow. The conveyor 38 conveys the sheet in this fashion into a wraparound and gluing station 40 of the outsert attachment.

The precision of the last fold, and the gluing of the wraparound fold 14, is accomplished by precisely positioning the folded sheet at the wraparound and gluing station 40. More specifically, the leading edge of the folded portion 39 is stopped in its forward travel by stops 41 and, in a fraction of a second of its stopping, a side jogging mechanism 42 is activated to push the folded sheet against a side stop 43 to that the sheet is positioned precisely. As soon as this occurs, an adhesive applicator 45 is actuated to apply one or more adhesive spots 15 to the folded section 39. Immediately following this, a folding means 48 which includes an overhead folding knife 49 is operated to fold the wraparound fold 14 against the adhesive spots 15 on the inner fold 16 thereby adhering the folds together and completing the formation of the outsert.

Typically, the sheet is printed with several outserts side-by-side which must then be separated. To accomplish this, the overhead folding knife 49 which engages the folded section 39 of the folded sheets pushes the folded section 39 into the nip of underlying folding rollers 50. The folding rollers 50 force the wraparound fold 14 tightly against the glue spots 15 and against the inner fold 16 to complete the outsert. The folding rollers 50 are also provided with circular knives 53 mounted on a pair of slitting rollers. 52 which slit the sheet into a multiplicity of side-by-side outserts. The outserts are then re-oriented and discharged automatically in an edge position into a container 22.

FIG. 3, which is also adapted from U.S. Pat. No. 4,812,195, illustrates in detail the side guiding mechanism used in the apparatus described therein. The illustrated side jogger 42 comprises a solenoid 150, slidably mounted on a support slide bracket 151 mounted on the inside of a stationary side frame member 156. The support bracket 151 has a slide channel 152 into which is mounted slide 153. Suitable lock fasteners 154 lock the slide 153 in position on the slide bracket 151 to position the solenoid plunger 158. Thus, the solenoid 150 can be positioned to accommodate various widths of sheets to be side jogged. The solenoid 150 includes a plunger 158 with a sheet pusher 159 mounted at its end. The sheet pusher 159 abuts against the side edge **39*a* of the folded sheet to push the same laterally, thereby bringing an opposite edge 39*b* of the folded sheet against the side stop 43 while the sheet slides along and against the forward stops 41. The solenoid 150 includes a return spring 161 extending between a head 162 on the plunger and the solenoid body 163. A stop nut 164 on the other threaded end 165 of the solenoid limits the return travel by the spring 161**.

The operation of the side jogger is as follows. The plunger/pusher 158/159, when activated by electronic sensing means, pushes the mostly folded paper against the side stop 43. This aligns (i.e., side-guides) the folded sheet for positive and consistent gluing and slitting. As the width of the mostly folded paper varies between different jobs in a typical range of 7 to 9 inches, and as the width of the paper may vary by about 1/16 of an inch during the course of a single job, a simple and safe method of adjusting both the plunger/pusher 158/159 and the side stop 43 is essential for the efficient and safe operation of the outsert attachment.

In the apparatus of U.S. Pat. No. 4,812,195, the plunger 158 extends through the body of the solenoid 150, and when the solenoid is electrically activated, the pusher 159 mounted on the end of plunger 158 travels approximately ¼ inch to ½ inch. The pusher/plunger is then returned to its original position by means of spring 161. The whole assembly is bolted directly onto the side frame member 156 of the outsert attachment. While the apparatus of U.S. Pat. No. 4,812,195 discloses that adjustment is possible by sliding the entire side jogging mechanism in slide bracket 151, the commercial embodiment of this apparatus is sold without this slide mechanism. In commercially available machines, the adjustment is maintained by the use of the locknut 154 and associated washers probably because the slide mechanism is unable to maintain the desired position of the pusher/plunger during the course of the run. The locknut and washers used in the commercial embodiment permit only a limited amount of adjustment for different jobs. The locknut and washers serve a dual purpose as they also regulate the amount of the plunger's return travel to the side frame member. Because the travel distance is severely limited, the operator must maintain an inventory of different size plungers and pushers to accommodate the various widths of outserts for different jobs.

When setting up the outsert attachment for actual operation, the proper combination of plungers and pushers has to be selected and then adjusted. At the same time, the position of the side stop also has to be adjusted. The stop is bolted directly onto the folding machine which is mounted inside the side frame members of the outsert attachment. To adjust the stopper, a set screw (not shown) has to be loosened and then the stopper can be slid to the desired position. The set screw is then tightened to hold it in place. As the stopper slides freely, finding a proper position can be very difficult. This is especially true since the stopper often slips out of position and requires further adjustment when the set screw is tightened. The entire process of finding the proper plunger/pusher combination and adjustment, and the proper stopper adjustment can take as long as an hour in an initial machine setup. Furthermore, during the course of a run, constant adjustment is required as the width of the mostly folded sheet may vary by as much as 1/16 of an inch. These adjustments add hours to the time needed to complete a run.

Additionally, because the above-described adjustment process is so cumbersome, it is often carried out in a dangerous manner. As it is quite difficult to make the proper adjustments while the machine is idle, many operators are tempted to make adjustments "on the fly," i.e., while the machine is running. When the adjustments are made on the fly, the operator can see very well if the outserts are being side-guided properly. However, the problem in making adjustments on the fly is that there are many moving metal parts in the immediate proximity of the pusher/plunger and side stop, including the circular slitting knives. It is exceedingly dangerous to make any adjustments at all while the slitting knives are in operation. Many accidents have occurred in this manner.

Another disadvantage of mounting the side stop directly onto the folding apparatus is that from time to time, the outsert attachment has to be removed from the rest of the machine for repair during a job. In such cases, the side stop also has to be removed and then re-installed when the outsert attachment is replaced. This entails the re-adjustment once again of the side stop with all the inconveniences associated therewith.

Accordingly, it is an object of the present invention to provide an outsert attachment which has a more efficient and a safer mechanism for adjusting the plunger/pusher and side stop combination.

SUMMARY OF THE INVENTION

The inventive side jogging mechanism for aligning a sheet to be folded into an outsert by an outsert folding apparatus comprises a frame including first and second oppositely disposed side frame members between which the outsert folding apparatus is received, an adjustable solenoid assembly mounted on the first side frame member, and a side stop assembly mounted on the second side frame member. The solenoid assembly includes a solenoid, a plunger extending from and actuated by the solenoid, and a pusher mounted at an end of the plunger located between the first and second side frame members. The side stop assembly includes a side stop located between the first and second side frame members. The solenoid assembly further includes an adjusting mechanism, e.g., a threaded shaft and handwheel, for adjusting the position of the pusher between the first and second side frame members, which adjusting mechanism is located outside the frame. Desirably, the side shop assembly also including an adjusting mechanism, e.g., a threaded shaft and handwheel, for adjusting the position of the side stop between the first and second side frame members, which adjusting mechanism is also located outside the frame.

DETAILED DESCRIPTION OF A PREFERRED EMBODIMENT

Figure 2:
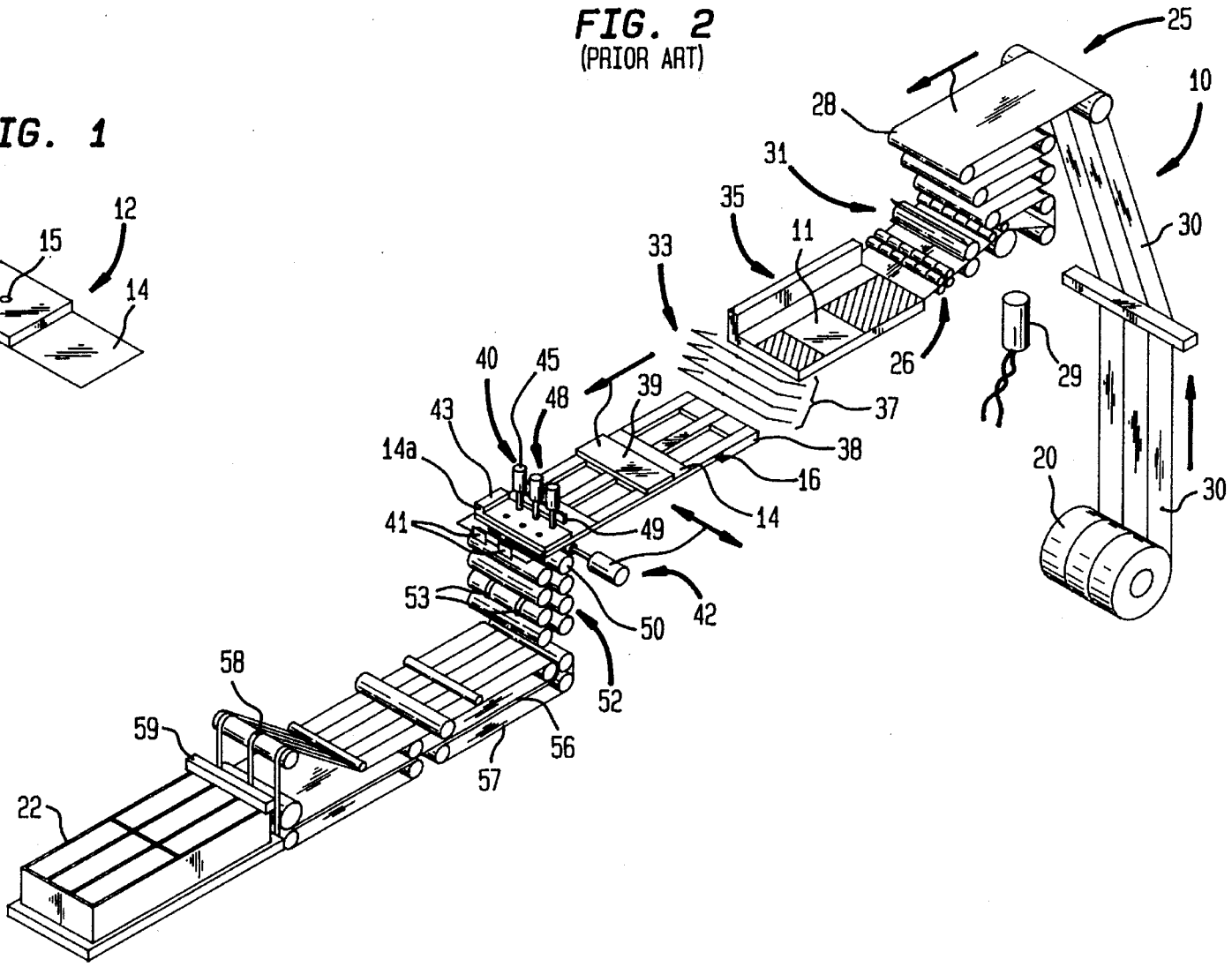
FIG. 2 (PRIOR ART)
FIG. 2 is a diagrammatic view illustrating the apparatus of U.S. Pat No. 4,812,195 for making outserts.
Figure 1:
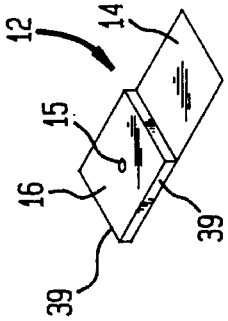
FIG. 1 illustrates an outsert prior to the last wrap-around panel being glued to the body of the outsert.
Figure 3:
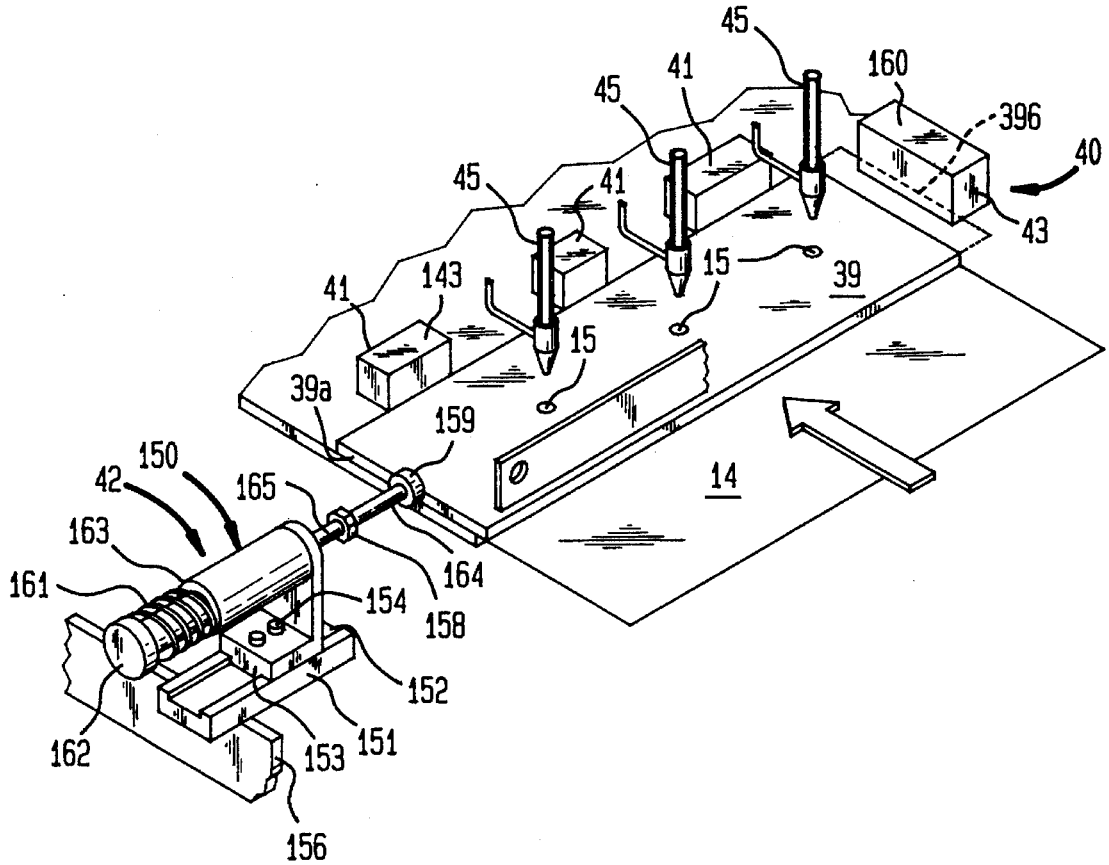
FIG. 3 (PRIOR ART)
FIG. 3 is a perspective view showing in detail the side jogging mechanism of U.S. Pat. No. 4,812,195.
Figure 4:
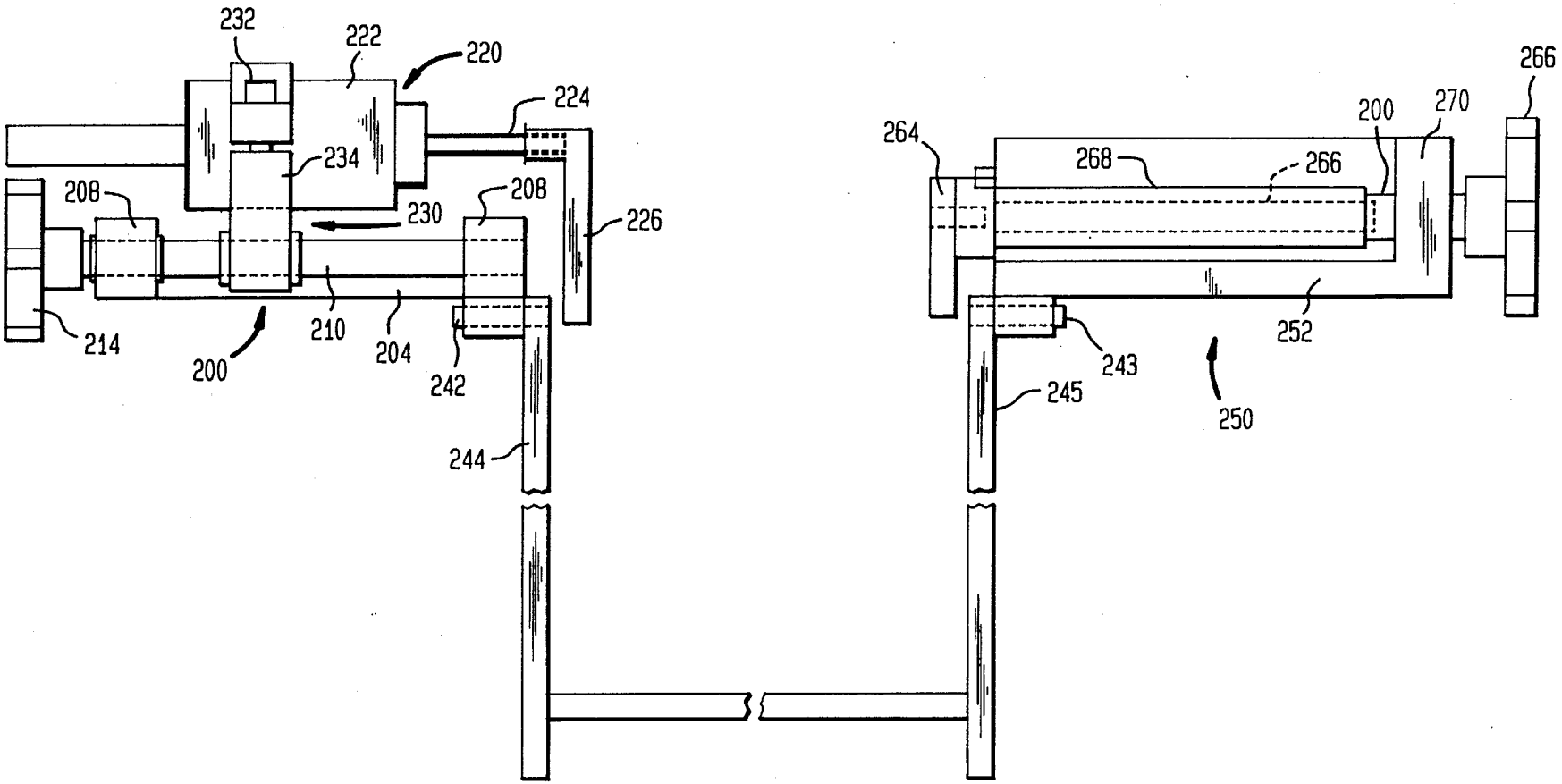
FIG. 4 is a plan view of the inventive side jogging mechanism.
Figure 6:
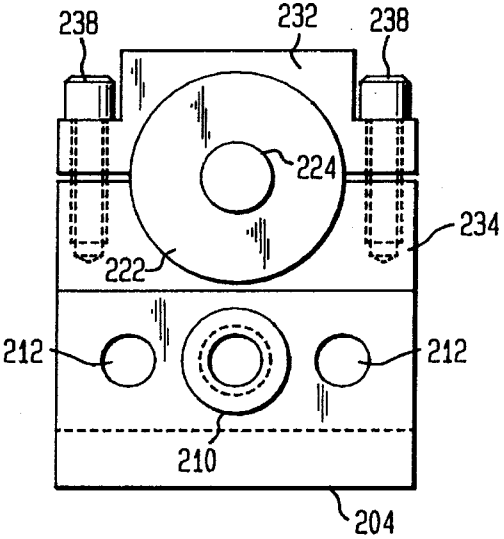
FIG. 6 is a front view of the pusher/plunger combination shown in FIG. 4.
Figure 7:
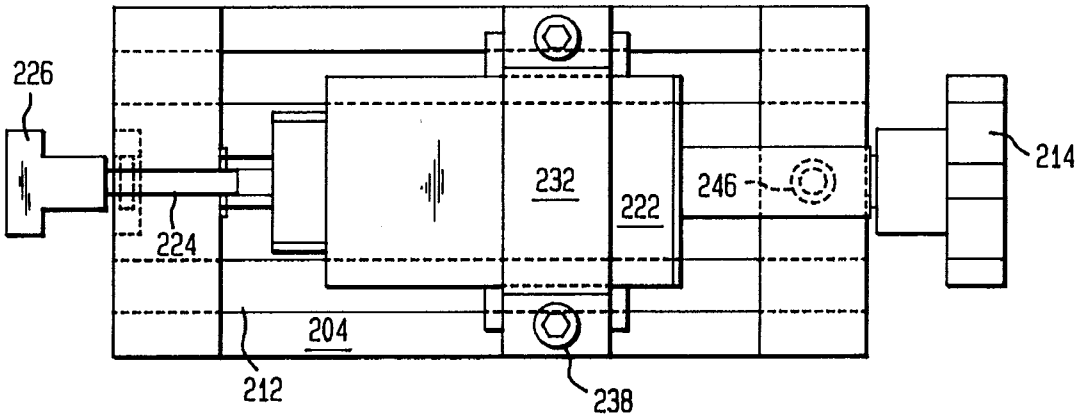
FIG. 7 is a top view of the pusher/plunger combination shown in FIG. 4.
Figure 8:
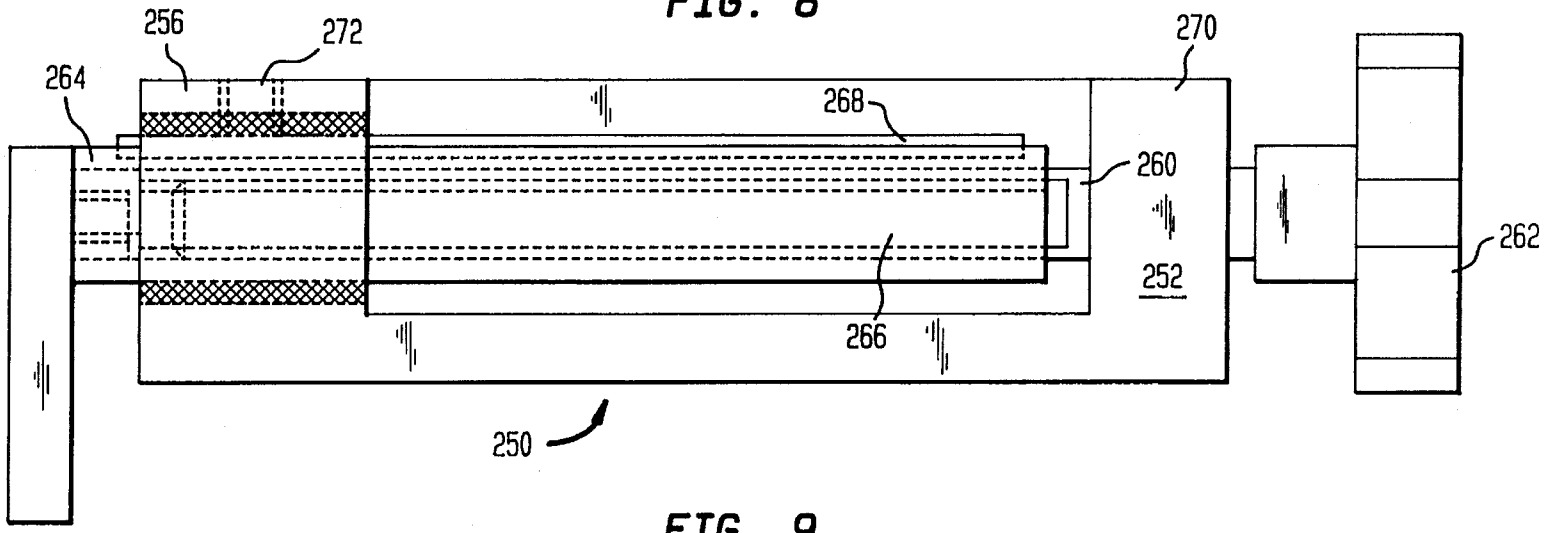
FIG. 8 is a side view of the side stop portion of the side jogging mechanism of the present invention.
Figure 9:
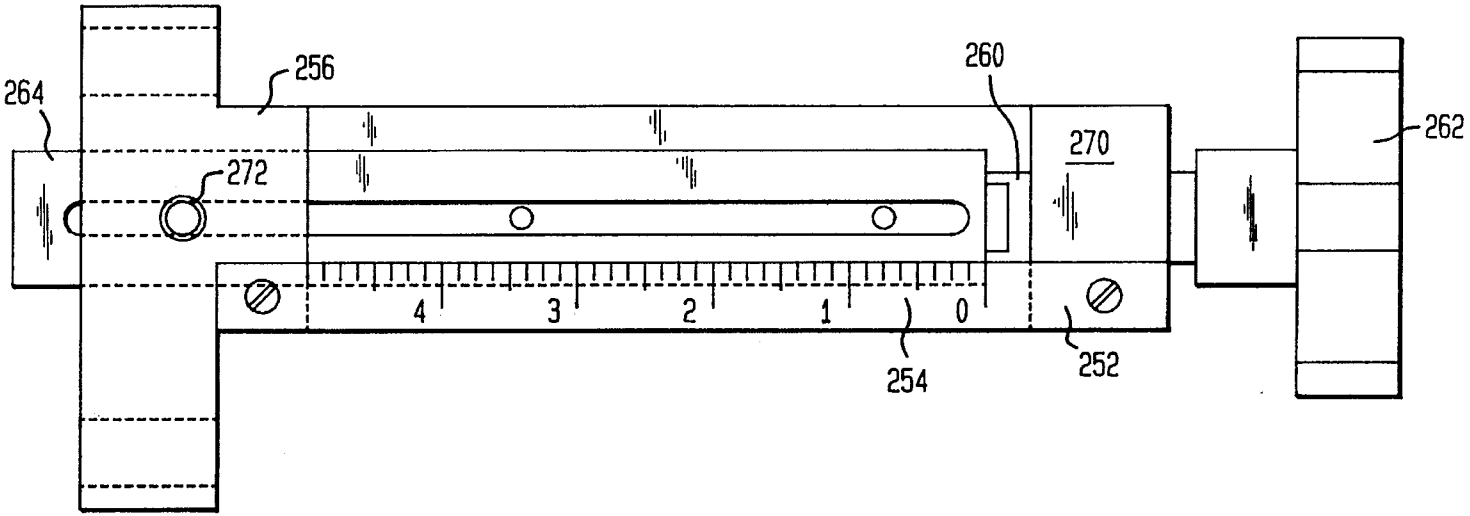
FIG. 9 is a top view of the side stop shown in FIG. 7.

A side jogging mechanism in accordance with the present invention comprises a solenoid assembly 200 (shown in FIGS. 4–7) and a side stop assembly 250 (shown in FIGS. 4 and 8–9). The solenoid assembly 200 comprises a lower part 202 and an upper part 220. The lower part 202 includes a flat base 204 having a graduated scale 206 drawn along one side, and upstanding members 208 which are mounted on the base 204. Through the upstanding members 208, a threaded shaft 210 and two subsidiary shafts 212 pass. A handwheel 214 is mounted at the end of threaded shaft 210. By means of handwheel 214, the threaded shaft 210 may be turned.

Figure 5:
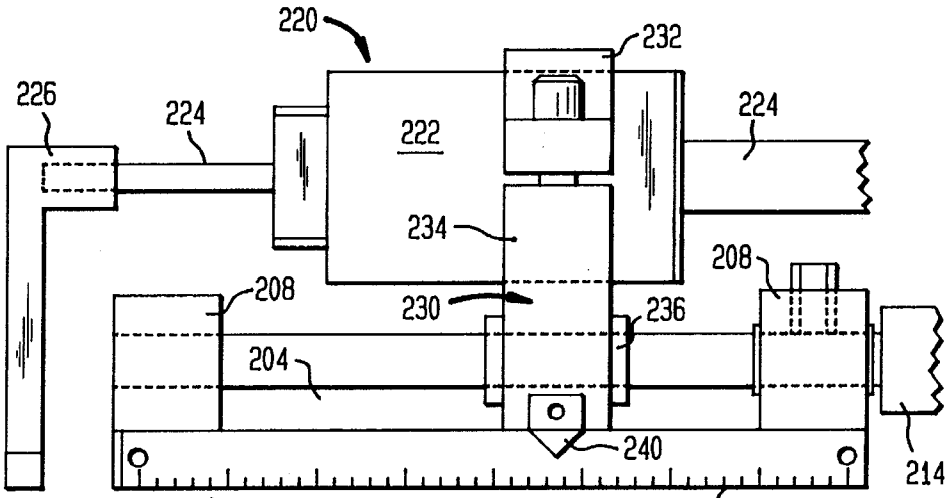
FIG. 5 is a side view showing the pusher/plunger combination of the inventive side jogging mechanism shown in FIG. 4.

The upper part 220 of solenoid assembly 200 comprises a solenoid 222, a plunger 224 which extends through solenoid 222, and a pusher 226 mounted on the end of plunger 224. The pusher 226 extends downwardly as shown in FIGS. 4 and 5 to about the level of base 204 of solenoid assembly 200. The upper part 220 of solenoid assembly 200 is mounted solidly to the lower part 202 by means of a bracket 230. The bracket 230 includes an upper section 232 which receives solenoid 222, and a lower section 234 which includes a threaded bore 236 and receives the threaded shaft 210. Bolts 238 hold the solenoid 222 firmly in place within the upper section 232 of bracket 230. A pointer 240 extends downwardly from bracket 230 so as to point at the graduated scale 206 of base 204.

As can best be seen in FIG. 4, the base 204 is mounted by means of bolts 242 on the side frame member 244 of one side of the outsert attachment in such manner that the handwheel 214 is outside of side frame member 244. When handwheel 214 is turned, threaded shaft 210 is caused to turn. As base 204 is fixed to the side frame member 244 of the outsert machine by means of bolts 242, the turning of threaded shaft 210 causes bracket 230 and with it the entire upper part 220, including solenoid 222, plunger 224, and pusher 226, to move laterally relative to base 204. Once the desired position of the upper part 220 of solenoid assembly 200 is obtained, this position is fixed by tightening set screw 246 (FIG. 7). Thus, the adjustment of the solenoid assembly 200 is accomplished by loosening set screw 246, turning the threaded shaft 210 by means of the handwheel 214 to reach the proper position, and then tightening the set screw 246 to prevent further movements due to machine vibrations. As the handwheel 214 is located outside the side frame member 244, all of these adjustments are made on the outside of the machine frame and away from dangerous moving parts, in contrast to the solenoid assembly of U.S. Pat. No. 4,812,195. Furthermore, precise positioning of the pusher/plunger can be achieved by means of the pointer 240 and the graduated scale 206.

Another advantage of solenoid assembly 200 is that only one pusher/plunger combination is needed. Although, the amount of travel is the same as in the solenoid assembly of U.S. Pat. No. 4,812,195, the solenoid, plunger, and pusher all move as one unit. Furthermore, their range of adjustment is about 3 to 3½ inches and is adequate for most, if not all, jobs. A similar range of adjustment is also possible for the side stop assembly 250 as will be described below. Thus, the total range of adjustment is about 6–7 inches which is clearly adequate for almost all jobs.

Turning now to FIGS. 4, 8 and 9, the side stop assembly 250 which is similar in many respects to solenoid assembly 200 is illustrated. Side stop assembly 250 comprises a flat base 252 having a graduated scale 254. By means of bolts 243, the base 252 of side stop assembly 250 is mounted onto side frame member 245 of the outsert machine. Thus, the bulk of side stop assembly 250 is located outside of the outsert machine. Two upstanding members 256 and 270 extend from base 252. Side stop assembly 250 includes a threaded shaft 260 at one end of which is a handwheel 262. A fine threaded shaft 266 is located within a sleeve 268. The shaft 260 passes through a threaded bore of upstanding member 270, while the sleeve 268 passes through a bore of upstanding member 256. A side stop 264 is mounted on the end of sleeve 268. Sleeve 268 includes keyway 269. A set screw 272 passes through the top of upstanding member 256 and keyway 269. A pointer (not shown) mounted on sleeve 268 extends downwardly and points to graduated scale 254.

To adjust the position of the side stop 264, the set screw 272 is first loosened. Thereafter, the handwheel 262 is turned. As the base 252 with its upstanding members 256 and 270 are fixed to the side member 245 of the outsert attachment, the turning of handwheel 262 causes the fine threaded shaft 266 to move relative to base 252. This causes the stop 264 to move as well. The keyway 269 provides clearance for the set screw 272 as the shaft assembly moves. Further, the pointer (not shown) moves across the graduation 254 at the same time. Once the adjustment is completed, the set screw 272 is tightened once again.

As the side stop assembly now extends over the side frame and is no longer mounted directly to the folding unit, the folding unit can be easily removed and replaced without loosening the stopper position. Most importantly, however, all adjustments are made on the outside of the frame machine and away from dangerous moving parts. This enables adjustments to made on the fly.

From an efficiency standpoint, the side guiding adjustment now takes no more than five minutes during the initial setup for the use of the outsert machine. Further, an expensive inventory of spare plunger/pusher combinations need not be stocked. As both side assembly positions are scaled, adjustment positions can be recorded and referenced for similar sized jobs in the future. Small adjustments are made well away from the moving parts, and adjustments can be made safely on the fly to compensate for variations in size of the mostly folded paper without stopping the entire machine.

While the invention has been described by reference to specific embodiments, this was for purposes of illustration only. Numerous alterative embodiments will be apparent to those skilled in the art and are considered to be within the scope of the invention.

I claim:

1. A side jogging mechanism for aligning a sheet to be folded into an outsert by an outsert folding apparatus, comprising a frame including first and second oppositely disposed side frame members between which said outsert folding apparatus is received, an adjustable solenoid assembly mounted on said first side frame member, said solenoid assembly including a solenoid, a plunger extending from and actuated by said solenoid, a pusher mounted at an end of said plunger and located between said first and second side frame members, and means for adjusting the location of said pusher between said first and second side frame members, a side stop assembly mounted on said second frame member and including a side stop located between said first and second side frame members, wherein said means for adjusting the location of said pusher is located outside said frame, and separate means for adjusting the location of said side stop between said first and second side frame members, wherein said means for adjusting the location of said stop being located outside said frame.

2. The side jogging mechanism of claim 1 wherein said solenoid assembly includes a base fixedly attached to said first side frame member, and a bracket which holds said solenoid, said bracket being mounted on said base.

3. The side jogging mechanism of claim 2 wherein said means for adjusting the location of said pusher comprises a threaded bore in said bracket, a threaded shaft passing through said threaded bore, and a handwheel located outside said frame attached to said threaded shaft, whereby turning said handwheel causes said bracket holding said solenoid to move relative to said base fixedly attached to said first side frame member.

4. The side jogging mechanism of claim 3 further comprising means for fixing the location of said bracket relative to said base.

5. The side jogging mechanism of claim 3 further comprising a graduation on said base and a pointer attached to said bracket whereby the location of said bracket along said base can be measured.

6. The side jogging mechanism of claim 1 wherein said side stop assembly includes a base fixedly attached to said second frame member and having a threaded bore therein, said means for adjusting the location of said side stop comprising a threaded shaft extending through said threaded bore, said side stop being mounted at a first end of said threaded shaft, and a handwheel attached to a second end of said threaded shaft and located outside said frame, whereby turning said handwheel causes said side stop to move relative to said base fixedly attached to said second frame member.

7. The side jogging mechanism of claim 6 further comprising means for fixing the location of said side stop relative to said base.

8. The side jogging mechanism of claim 7 further comprising a graduation on said base and a pointer attached to said threaded shaft whereby the location of said side stop relative to said base can be measured.

* * * * *